US007548204B2

(12) United States Patent
Arnold et al.

(10) Patent No.: US 7,548,204 B2
(45) Date of Patent: Jun. 16, 2009

(54) BROADBAND ANTENNA SMALLER STRUCTURE HEIGHT

(75) Inventors: Eugen Arnold, Ulm (DE); Ingo Walter, Siegen (DE); Ullrich Fuchs, Dettingen (DE); Birgit Michael, Ulm (DE)

(73) Assignee: EADS Deutschland GmbH, Ottobrunn (DE)

( * ) Notice: Subject to any disclaimer, the term of this patent is extended or adjusted under 35 U.S.C. 154(b) by 396 days.

(21) Appl. No.: 11/187,881

(22) Filed: Jul. 25, 2005

(65) Prior Publication Data

US 2006/0044201 A1 Mar. 2, 2006

(30) Foreign Application Priority Data

Jul. 23, 2004 (DE) ..... 10 2004 036 001

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/713, 343/700 MS, 746, 907, 904, 846, 848, 793, 343/797, 810–820
See application file for complete search history.

(56) References Cited

U.S. PATENT DOCUMENTS

| | | | | |
|---|---|---|---|---|
| 4,546,358 | A | 10/1985 | Edlin et al. | |
| 5,440,316 | A | 8/1995 | Podgorski et al. | |
| 5,734,350 | A | 3/1998 | Deming et al. | |
| 6,002,367 | A * | 12/1999 | Engblom et al. | 343/700 MS |
| 6,249,254 | B1 * | 6/2001 | Bateman et al. | 343/700 MS |
| 6,326,919 | B1 * | 12/2001 | Diximus et al. | 343/700 MS |
| 6,466,176 | B1 | 10/2002 | Maoz et al. | |
| 6,590,540 | B1 * | 7/2003 | Adams et al. | 343/718 |
| 6,667,716 | B2 * | 12/2003 | Chen | 343/700 MS |
| 6,911,940 | B2 * | 6/2005 | Poilasne et al. | 343/700 MS |
| 7,012,572 | B1 * | 3/2006 | Schaffner et al. | 343/725 |
| 2001/0050636 | A1 | 12/2001 | Weinberger | |
| 2002/0021249 | A1 | 2/2002 | Kuck | |
| 2003/0020668 | A1 * | 1/2003 | Peterson | 343/846 |
| 2003/0052827 | A1 | 3/2003 | Umeara et al. | |
| 2005/0159195 | A1 | 7/2005 | Huber et al. | |

FOREIGN PATENT DOCUMENTS

| | | | |
|---|---|---|---|
| DE | 102 04 877 | A1 | 8/2003 |
| EP | 1 052 723 | A2 | 11/2000 |

(Continued)

OTHER PUBLICATIONS

Jieh-Sen Kuo and Kin-Lu Wong "Dual-Frequency Operation of A Planar Inverted-L Antenna with Tapered Patch Width" Department of Electrical Engineering National Sun Yat-Sen University Kaohsing, Taiwan 804, R.O.C. Microwave And Optical Technology Letter? vol. 28, No. 2, Jan. 20, 2001.*

(Continued)

*Primary Examiner*—Shih-Chao Chen
(74) *Attorney, Agent, or Firm*—Crowell & Moring LLP

(57) ABSTRACT

An antenna having a radiating surface (1) and a base surface (2). One or more discrete components (3) are arranged between the radiating surface (1) and the base surface (2). The radiating surface (1) has a tapering with respect to its width B and with respect to its height H from the base surface (2).

4 Claims, 5 Drawing Sheets

FOREIGN PATENT DOCUMENTS

| | | | |
|---|---|---|---|
| EP | 1 209 760 | A2 | 5/2002 |
| EP | 1 263 083 | A2 | 12/2002 |
| EP | 0 989 628 | B1 | 8/2003 |
| FR | 2 791 815 | A1 | 10/2000 |
| WO | WO 2004/021514 | A1 | 3/2004 |

OTHER PUBLICATIONS

European Search Report Dated Sep. 21, 2005 (seven (7) pages).
European Search Report Dated Nov. 3, 2005 (nine (9) pages) w/ English translation of relevant portion.

* cited by examiner

BROADBAND ANTENNA SMALLER STRUCTURE HEIGHT

This application claims the priority of German application no DE 10 2004 036 001.4, filed Jul. 23, 2004, the disclosure of which is expressly incorporated by reference herein.

BACKGROUND AND SUMMARY OF THE INVENTION

The invention relates to an antenna comprising a radiating surface and a base surface.

Strip antennas, also called patch antennas, are characterized by a low weight and a small cross-section, which results in an easy handling and a wide field of application.

Known strip antennas consist of a metal strip which is arranged at a definable distance parallel to a metallic base surface. A homogeneous dielectric is usually situated between the strip and the base surface. The length of the metal strip is selected such that the electric length of the line which the strip forms together with the base surface is approximately half a wavelength (in the dielectric) long. The width of the metal surface essentially defines the impedance of the antenna; the distance of the strip from the base surface essentially determines the bandwidth. This distance is simultaneously the overall height of the strip antenna. Normally, the overall height is between one twentieth and one fifth of the free-space wavelength at band center, a greater overall height resulting in a higher bandwidth.

One disadvantage of the strip antennas is the small bandwidth. For enlarging the bandwidth, for example, the shape of the metal strip is selected such that the resonance frequencies of two or more oscillation modes of the antenna have a relatively small frequency spacing. As a result, bandwidth ratios of up to 1.6:1 can be reached. The bandwidth ratio is defined as the ratio of the upper frequency limit to the lower frequency limit. Such strip antennas are known, for example, from European Patent Document EP 0 939 628 B1 and International Patent Document WO 2004/021514 A1.

European Patent Document EP 0 989 628 B1 provides that the base surface is connected with the radiating surface by means of a coaxial cable, the coaxial cable being used for guiding signals to the radiating surface. In this case, the base surface has a vertical edge which extends in a vertical manner from the base surface, so that an "L"-shaped or "U"-shaped cross-section is obtained. One disadvantage of this arrangement is that the bandwidth is too small for certain fields of application.

For certain commercial and military fields of application such as hopping operations for military communication services, battlefield monitoring systems, transmission systems where several transmitters operating at different frequencies are simultaneously connected to the same antenna, and for corresponding receiving systems, antennas are required which, although they have a low overall height and a small size, have a considerably larger bandwidth than can be achieved by means of strip antennas. There are naturally other types of antennas which have the required bandwidth ratio. However, in many cases, these have significantly larger dimensions.

It is therefore an object of the invention to provide an improved antenna by means of which the bandwidth can be increased significantly.

The antenna according to the invention has one or more discrete components arranged between the radiating surface and the base surface, the radiating surface having a tapering with respect to its width B and with respect to its height H to the base surface. The term "tapering" means in this case that, along the longitudinal dimension L of the radiating surface, the width B as well as the height H of the radiating surface vary over the base surface.

The radiating surface advantageously has a maximal length $L_{max} \leqq 0.6\ \lambda_{max}$, a maximal width $B_{max} \leqq \lambda_{max}$, and a maximal height $H_{max} \leqq 0.4\ \lambda_{max}$ with respect to the base surface, $\lambda_{max}$ being the free-space wavelength at the lower frequency limit $f_u$ of the frequency band of the antenna. For the standing wave ratio VSWR, in a frequency range $[f_u, f_o]$ with $f_u$ and $f_o$ as the lower and upper frequency limit of the frequency band of the antenna, preferably VSWR$\leqq$3 applies, for the bandwidth, $f_o/f_u \geqq 1.4$.

The radiating surface advantageously has a constant tapering. In this case, the radiating surface has the shape of an isosceles triangle. The radiating surface together with the base surface forms a TEM waveguide with a constant characteristic wave impedance.

The devices for feeding electromagnetic energy to the antenna are preferably arranged in the area of the smallest distance between the radiating surface and the base surface. For a triangular radiating surface, this can expediently be a corner of the radiating surface.

The feeding preferably is a coaxial feeding. The coaxial internal conductor is physically connected with the radiating surface, while the external conductor is physically connected with the base surface of the antenna. The tapering of the width of the radiating surface and of the height of the radiating surface over the base surface is expediently selected to fit the impedance of the connected feeding cable, because then the higher oscillation modes of the antenna occurring at the feeding point are excited only with a low amplitude.

The discrete components, which are distributed below the radiating surface at predefinable sites with predefinable values, are used for improving the adaptation for the lower part of the frequency range. Values and sites can be selected corresponding to the respective demands on the adaptation and on the radiation diagram of the antenna. The discrete components may particularly be inductances and/or capacitances.

However, shapes other than triangular shapes and non-constant height and width tapering of the radiating surface of the antenna also make sense in special cases. As a result, further improvements of the adaptation and the shape of the radiation diagram are conceivable.

The term "discrete component" is understood in the functional sense. Instead of a discrete inductance or capacitance, an implementation as a conduction printed on a substrate (not shown) can also be used.

The antenna according to the invention permits a very broadband radio operation, such as a hopping operation. In addition, a simultaneous feeding of the antenna by means of several transmission lines, which are distributed in a wide frequency range, is conceivable. Furthermore, it becomes possible by means of the antenna according to the invention to simultaneously receive several received signals situated in a broad frequency band.

Another advantage of the antenna according to the invention is the possibility of using this broadband antenna directly in front of a metallic or non-metallic wall without an impairment of its adaptation or its radiation diagram. This can also be achieved in the case of a conformal adaptation of the radiating surface to a possibly curved shape of the metallic wall. In the case of a metallic wall, the wall itself can be used as a base surface. The wall could, for example, be part of the surface of a vehicle, a ship or an airplane. As a result of the low overall height of the antenna, the antenna projects only slightly beyond the vehicle surface. This applies to implementations for the VHF range, the UHF range and naturally for the microwave range.

Other objects, advantages and novel features of the present invention will become apparent from the following detailed description of the invention when considered in conjunction with the accompanying drawings.

The invention as well as additional advantageous embodiments of the invention will be explained in detail in the following by means of drawings.

DETAILED DESCRIPTION OF THE DRAWINGS

Figure 1:
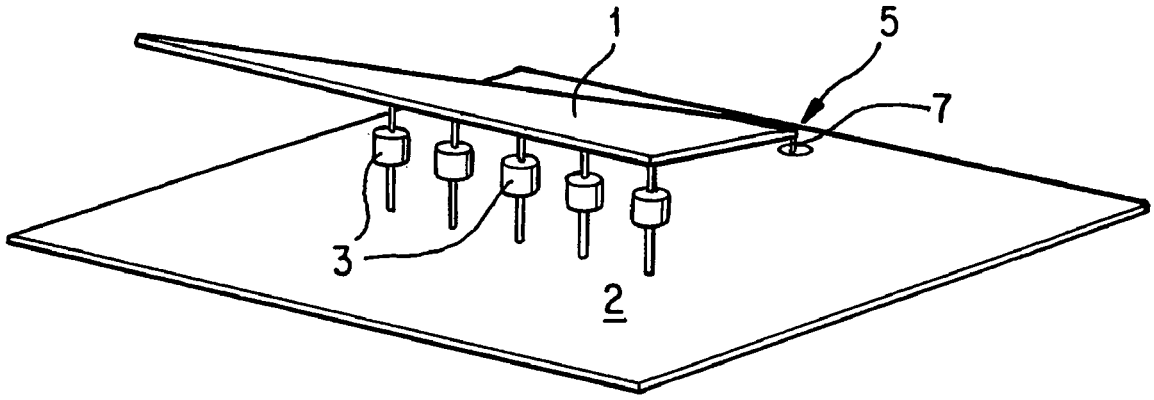
FIG. 1 is a perspective view of a first embodiment of an antenna construction according to the present invention.
Figure 2:
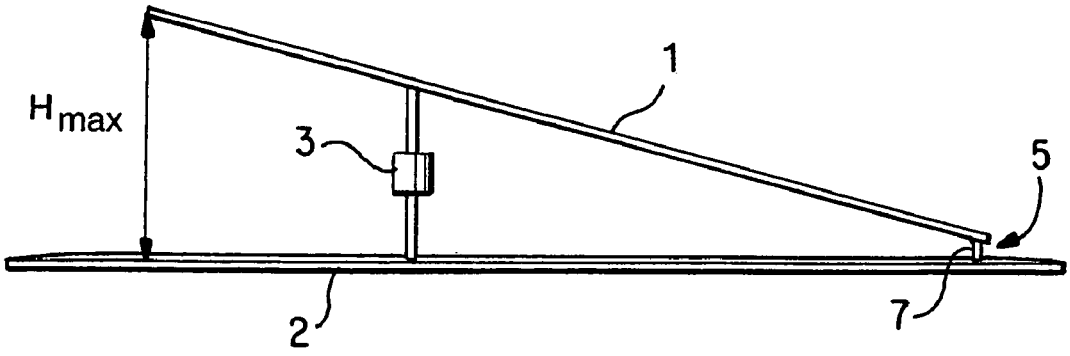
FIG. 2 is a lateral view of the antenna construction of FIG. 1.
Figure 3:
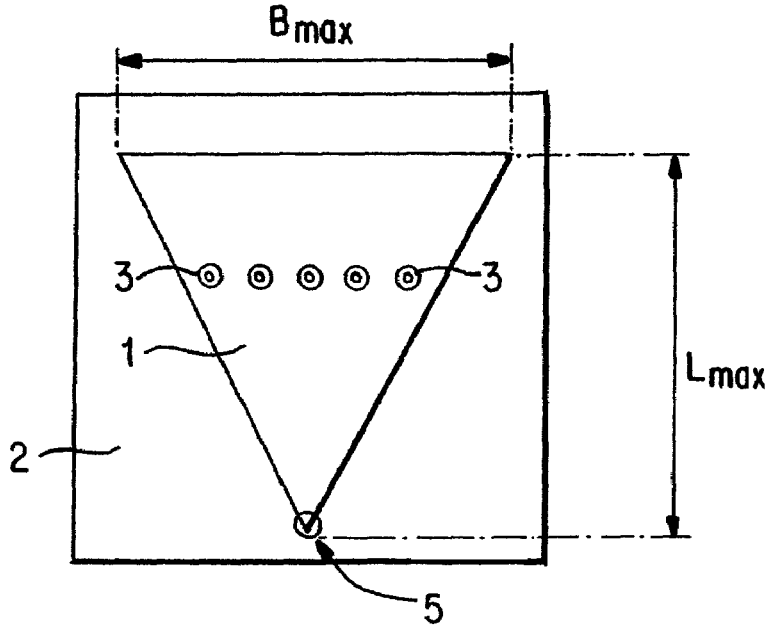
FIG. 3 is a top view of the antenna construction of FIG. 1.

The antenna element in a construction of a first preferred embodiment according to FIGS. 1 to 3 comprises a radiating surface 1 and a metallic base surface 2. Expediently, a connection 7—in the following, called signal connection—particularly in the form of a coaxial cable (not shown), exists for feeding signals to the radiating surface 1. In this case, the signal connection 7 by means of a coaxial cable can take place by measures known to a person skilled in the art, the internal conductor of the coaxial cable being conductively connected with the radiating surface 1 and the external conductor of the coaxial cable being conductively connected with the base surface 2. The antenna element can expediently be accommodated in a housing (not shown). Discrete components 3 are provided between the radiating surface 1 and the metallic base surface 2.

In the area 5 of the signal connection 7, preferably devices, such as pins (not shown), may be provided which permit a secure holding of the radiating surface 1 in a fixed position separated from the base surface 2. These pins expediently consist of electrically non-conductive material, for example, plastic material. Naturally, other holding devices known to a person skilled in the art are also conceivable, such as the filling of the space area between the base surface 2 and the radiating surface 1 with a dielectric material with a fitting dielectric constant.

Figure 4:
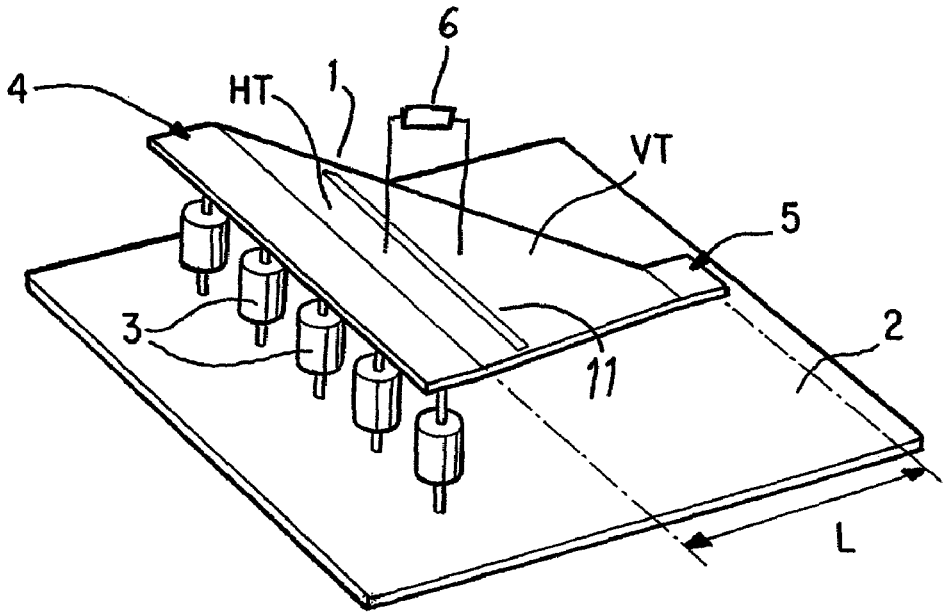
FIG. 4 is a perspective view of a second embodiment of an antenna construction according to the present invention.

FIG. 4 shows a second embodiment of an antenna according to the invention. In the case of this embodiment, the parts of the radiating surface 1 in the area 4 of the discrete components 3 and/or in the area 5 of the signal connection (not shown) are constructed parallel to the base surface 2. As a result, the handling of the radiating surface 1 and particularly the fastening of the discrete components 3 and of the signal connection to the radiating surface 1 can be improved.

In the area 4 of the discrete components 3, the radiating surface 1 has, for example, a distance value $H_{max}$ of $0.13*\lambda_{max}$, from the base surface 2, $\lambda_{max}$ being the free-space wavelength at the lower frequency limit $f_u$ of the frequency band of the antenna. Here, the distance $H_{max}$ is expediently determined as a perpendicular onto the base surface 2. The value $L_{max}$ amounts, for example, to $0.25*\lambda_{max}$; the value $B_{max}$ amounts, for example, also to $0.25*\lambda_{max}$. The site and the value of the discrete components are selected as a function of $H_{max}$, $L_{max}$ and $B_{max}$. Naturally, the distance $H_{max}$ between the radiating surface 1 and the base surface 2 in the area 4 of the discrete components 3 can be changed for reasons of an improved adaptation.

Advantageously, the radiating surface 1 has a slot 11 constructed perpendicularly to its longitudinal dimension L. As a result, the radiating surface 1 is split into a rearward part HT and into a forward part VT. Advantageously, this slot 11 is bridged by discrete dummy elements 6, such as inductances. In addition to the large broadband characteristic, which causes the connecting of suitable dummy elements, as a result of the value and the site of the dummy elements, the radiation diagram of the antenna can also be influenced.

The term "discrete dummy element" has a functional meaning. Naturally, instead of a discrete inductance, an implementation as a conduction printed on a substrate (not shown) can also be used.

Figure 8:
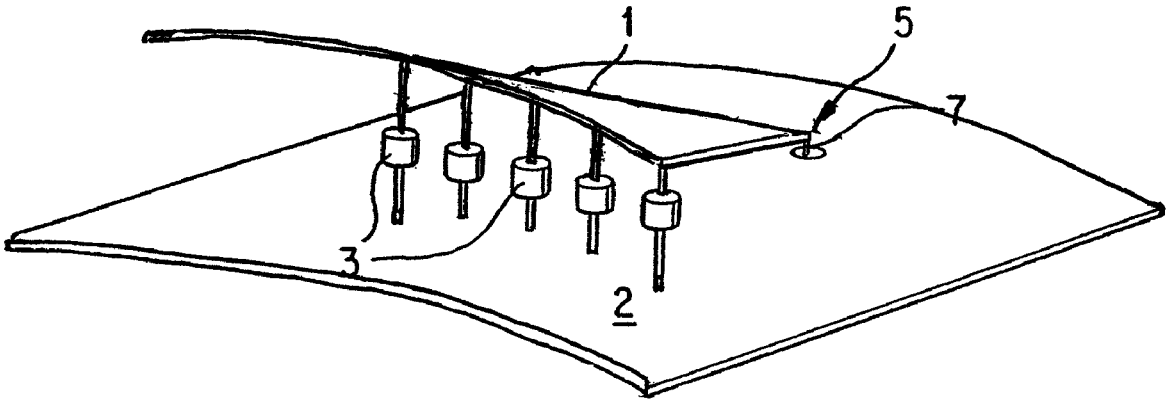
FIG. 8 is a view of another embodiment of the invention.

In the first and second embodiment of the invention, the base surface 2 can advantageously have a plane, single-curvature or double-curvature construction and the radiating surface 1 may have a construction conformal to the curvature of the base surface 2, as shown in FIG. 8. This permits the mounting of the antenna construction also on arbitrarily shaped carrier structures with a small space requirement.

Figure 5:
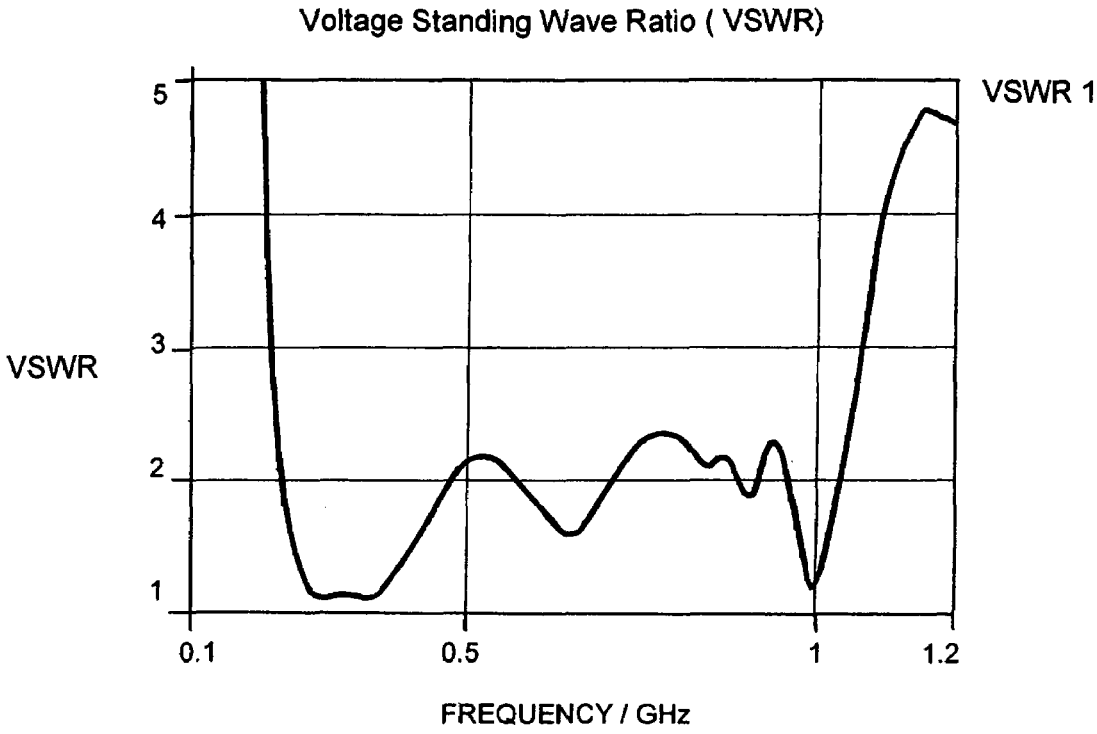
FIG. 5 is a view of the course of the curve of the standing wave ratio at the feeding point of the embodiment illustrated in FIG. 4 as a function of the frequency.

FIG. 5 shows the course of the curve of the standing wave ratio VSWR at the feeding point of the signal connection of the embodiment illustrated in FIG. 4, as a function of the frequency. The basic ratio of standing waves is computed based on the scattering of the voltage which is measured at the input of the connection of the feeding devices at the radiating surface 1.

In the frequency range of from 220-450 MHz, the standing wave ratio VSWR amounts to less than 2. In the entire frequency band from 200-1,050 MHz, the standing wave ratio amounts to less than 3.

Figure 6:
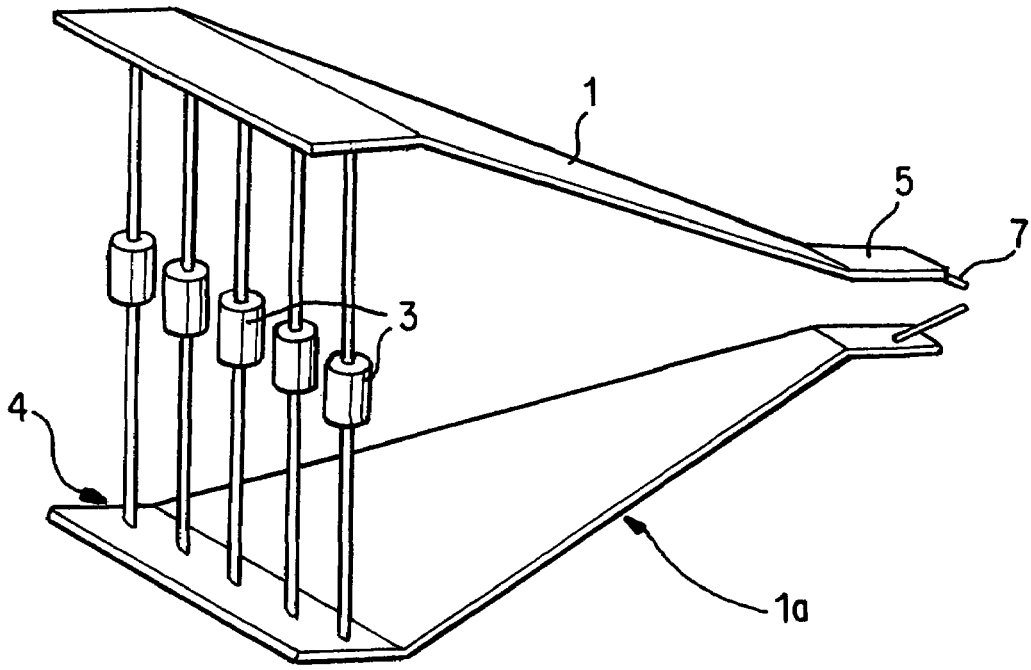
FIG. 6 is a view of a third embodiment of an antenna according to the invention having a second radiating surface.

FIG. 6 shows a third embodiment of an antenna according to the invention. In this embodiment, the base surface is replaced by a second radiating surface 1*a*, the second radiating surface 1*a* being mirrored at the plane (not shown) set up by the base surface.

The parts of the radiating surface 1, 1*a* in the area 4 of the discrete components 3 and/or in the area 5 of the connection 7 are constructed parallel to the base surface. Naturally, it is also conceivable that the radiating surfaces 1, 1*a* have a shape illustrated in FIGS. 1 and 2.

Figure 7:
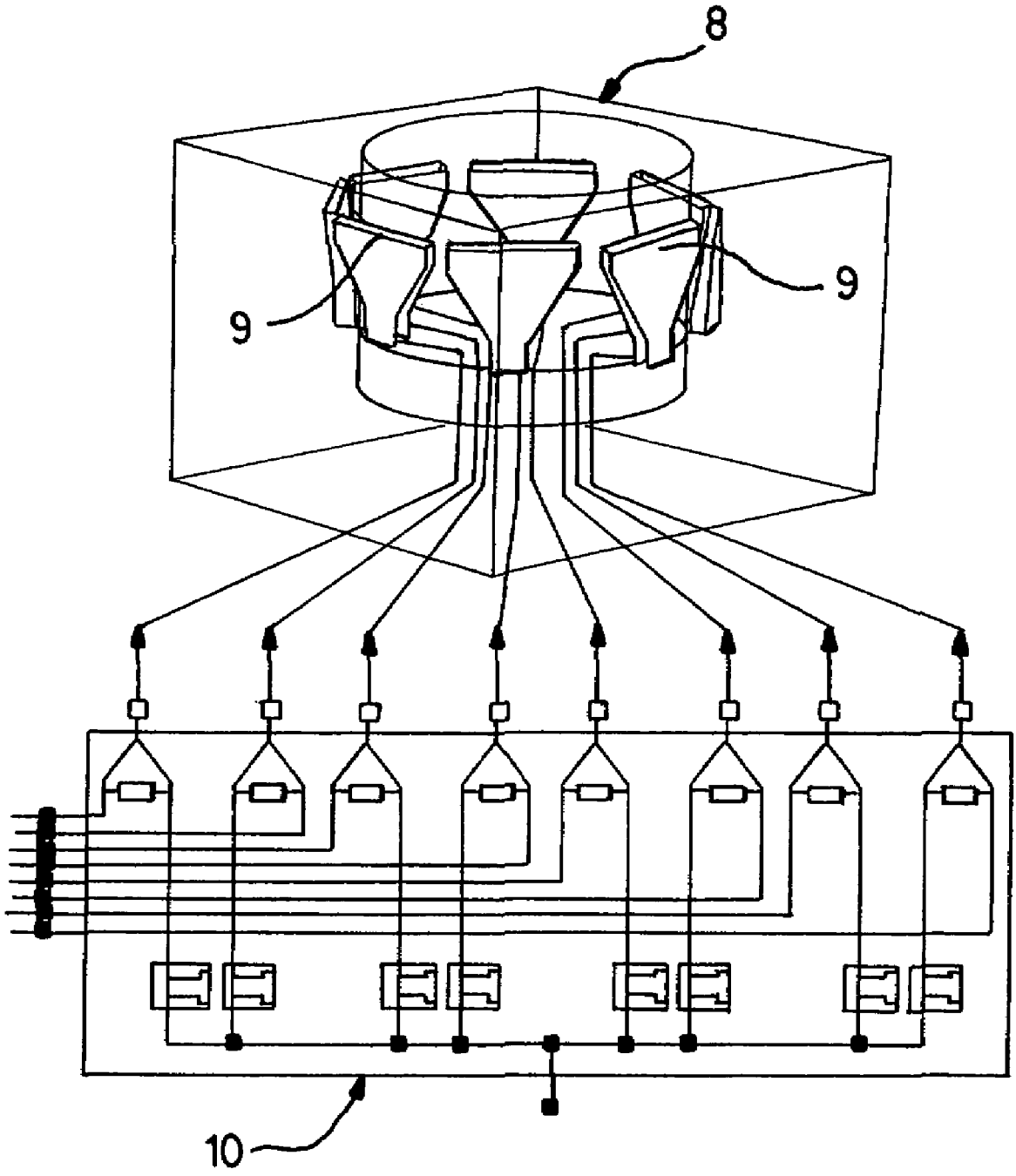
FIG. 7 is a view of an embodiment, used as an example, of a use of an antenna of a first or second embodiment according to the invention.

FIG. 7 illustrates an embodiment, used as an example, of a use of an antenna according to the invention. Several antennas 9 are arranged at the circumference of a cylinder 8. Expediently, the shape of the cylinder 8 may be similar to the mast of a ship. The antennas 9 are placed on the exterior surface of the cylinder 8 and are used as transmitting antennas for different frequency ranges. In this case, possible transmitting and receiving ranges respectively are, for example, 30-100 MHz, 100-200 MHz and 200-600 MHz.

The cylinder arrays are used in the transmission case for communication and electronic countermeasures for interfering with the enemy's communication equipment. In the reception case, the arrays are used for communication and for electronic support measures, that is, acquisition, position finding and classification of foreign communication equipment. The antennas 9 are expediently distributed by way of so-called beamforming networks 10 in sum patterns as well as radiating element patterns to terminal equipment, thus transmitters and receivers.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An antenna structure comprising a radiating surface and a base surface, wherein:

at least one discrete component is arranged between the radiating surface and the base surface;

the radiating surface has a width B and has a tapering with respect to said width B and with respect to a height H which is a measure of a distance between said radiating surface and said base surface;

the radiating surface has a slot implemented perpendicular to its longitudinal dimension L, the slot being surrounded on all sides by the radiating surface; and the slot is bridged by at least one discrete reactive element that influences a radiation diagram of the antenna structure.

2. An antenna structure comprising a radiating surface and a base surface, wherein:

at least one discrete component is arranged between the radiating surface and the base surface;

the radiating surface has a width B and has a tapering with respect to said width B and with respect to a height H which is a measure of a distance between said radiating surface and said base surface;

the radiating surface has a non-constant tapering with respect to the height H and the width B;

the base surface has a configuration that is one of planar and curved; and the radiating surface has a configuration conformal with the configuration of the base surface.

3. An arrangement comprising a plurality of antenna structures, each of the plurality of antenna structures comprising:

a first radiating surface and a second radiating surface offset from each other, wherein at least one discrete component is arranged between said first and second radiating surfaces, each of said first and second radiating surfaces having a width and a tapering with respect to said width and with respect to a distance from each of said first and second radiating surfaces to a plane bisecting a distance between said first and second radiating surfaces with said first and second radiating surfaces mirroring said bisecting plane, wherein the plurality of antenna structures are arranged along a circumference of a cylinder-shaped supporting structure.

4. The arrangement according to claim 3, wherein the plurality of antenna structures are connected with one another by way of beamforming networks.

* * * * *